US006658874B1

(12) United States Patent
Trent

(10) Patent No.: US 6,658,874 B1
(45) Date of Patent: Dec. 9, 2003

(54) ADVANCED, ENERGY EFFICIENT AIR CONDITIONING, DEHUMIDIFICATION AND REHEAT METHOD AND APPARATUS

(76) Inventor: Richard W. Trent, 109 Wappoo Creek Dr., Suite 4B, Charleston, SC (US) 29412

( * ) Notice: Subject to any disclaimer, the term of this patent is extended or adjusted under 35 U.S.C. 154(b) by 0 days.

(21) Appl. No.: 09/882,498

(22) Filed: Jun. 15, 2001

Related U.S. Application Data

(63) Continuation-in-part of application No. 09/547,828, filed on Apr. 12, 2000, now abandoned.
(60) Provisional application No. 60/128,775, filed on Apr. 12, 1999.

(51) Int. Cl.[7] ..... F25B 29/00; G05D 23/00
(52) U.S. Cl. ..... 62/173; 62/90; 165/298
(58) Field of Search ..... 62/173, 90; 165/297, 165/298

(56) References Cited

U.S. PATENT DOCUMENTS 4,216,903 A * 8/1980 Giuffre ..... 237/8 R
5,622,057 A * 4/1997 Bussjager et al. ..... 62/173
5,904,292 A * 5/1999 McIntosh ..... 165/297 X

* cited by examiner

*Primary Examiner*—William Wayner
(74) *Attorney, Agent, or Firm*—Edward P. Dutkiewicz

(57) ABSTRACT

An air conditioner controller comprises a supply air duct with an air inlet, an air outlet and a blower. An evaporator is within the duct adjacent to the inlet. A subcooling heat exchanger is within the duct between the evaporator and the outlet. A liquid line feeds coolant from a condenser. The liquid line has a primary outlet coupled to the subcooling heat exchanger and a secondary outlet coupled to a first valve. A coupling line feeds coolant from the subcooling heat exchanger to an evaporator. The coupling line has a second valve adjacent to the subcooling heat exchanger and an intermediate line. A humidistat, under the control of an operator, controls the first and second valve to thereby vary the operating parameters.

4 Claims, 10 Drawing Sheets

ADVANCED, ENERGY EFFICIENT AIR CONDITIONING, DEHUMIDIFICATION AND REHEAT METHOD AND APPARATUS

RELATED APPLICATIONS

This application is a Continuation-in-Part of U.S. application Ser. No. 09/547,828 filed Apr. 12, 2000, now abandoned and also claims the benefit of U.S. Provisional Application No. 60/128,775 filed Apr. 12, 1999, which applications are incorporated herein by reference.

BACKGROUND OF THE INVENTION

1. Field of the Invention

The present invention relates to the field of heating, ventilation and air conditioning, and more particularly, to an apparatus for controlling relative humidity in a controlled and energy efficient manner.

2. Description of the Related Art

Heating, ventilation and air conditioning systems and equipment are commonly used to provide control of temperature and relative humidity for comfort and the control of particles and other indoor pollutants in buildings. Recent changes in codes and industry standards from agencies such as the American Society of Heating, Refrigeration and Air Conditioning Engineers (ASHRAE) mandate and/or suggest changes that require stricter control of relative humidity and increases in the amount of fresh air that circulates in a building. Because fresh, outside air can contain large amounts of moisture, the difficulty in controlling relative humidity in a building increases as the amount of outside air circulation increases. Reducing relative humidity creates a more comfortable, healthier indoor environment for humans by controlling the growth of mold bacteria and viruses.

In a conventional air conditioning system a refrigerant working fluid moves in a cycle from a compressor through a condenser to an evaporator and return to the compressor. A fan creates a flow of air across the evaporator, in the case of a direct expansion system or a cooling coil in the case of a chilled water system, and cools the air to a temperature near or below the dew point. Typically the air leaving the evaporator is saturated with moisture.

In some air conditioning systems, the air is reheated after being cooled by the evaporator. Air moving through an evaporator typically changes temperature from about 80° F. to 55° F. or lower. As the air is cooled, it reaches the dew point (approximately 60° F.) at which temperature moisture removal (dehumidification) begins. As the temperature of the air is lowered below the dew point, additional moisture is removed. Such cooling normally produces air that is colder than desired for human comfort. However, this degree of cooling is often required to provide the necessary amount of dehumidification. In essence, the evaporator, or cooling coil overcools the air in order to remove the moisture. A reheater then heats the air to a comfortable level for humans thereby lowering the relative humidity of the air. This process is very energy inefficient because excess energy is used to overcool and dehumidify the air and even more energy is used to reheat the cold air.

One approach to reheating the air leaving an evaporator is disclosed in U.S. Pat. No. 4,813,474 to Amaze where electric resistance heaters are used for reheating the air. This approach is very energy intensive. In addition, some jurisdictions limit the use of electric resistance heat for reheating air leaving an evaporator to certain applications. One example of this is the state of Florida.

Other approaches to reheating have been disclosed. For example, pumped run-around loops have been disclosed in U.S. Pat. Nos. 5,337,577, 5,228,302 and 5,181,552 all to Eirmann. A limited amount of reheat energy is provided by the run-around loop unless a supplemental heat source is used. This heat source along with the pump used to circulate the fluid in the run-around loop consume additional energy and reduce the energy efficiency of the system. U.S. Pat. No. 5,329,782 to Hyde discloses a liquid amplification pump connected between the outlet of a condenser and a liquid subcooling coil positioned in the air leaving an evaporator.

Another approach, illustrated in U.S. Pat. No. 5,265,433 to Beckwith, discloses an air conditioning system comprised of a subcool coil coupled to the liquid line leaving a condenser through a supplemental heat pipe heat exchanger loop comprised of a heat exchanger and said subcool coil. In addition, a second source of reheat is disclosed being comprised of a second supplemental heat pipe heat exchanger loop comprised of a heat exchanger coupled to the hot gas discharge line of a compressor and a coil disposed in the air leaving the subcool coil. This system is limited as to the amount of reheat it can provide.

In order to increase the moisture removal of air conditioning systems and provide passive reheat, heat pipe heat exchangers have been used. Such systems are disclosed in U.S. Pat. Nos. 2,093,725 to Hull; U.S. Pat. No. 4,607,498 to Dinh; U.S. Pat. No. 4,971,139 to Khattar and U.S. Pat. No. 5,695,004 to Beckwith. In these references, the heat pipe is used to transfer heat from the return air into the supply air of an air conditioning system using the technology of heat pipe heat exchangers.

Heat pipe exchangers are passive devices that are comprised of an evaporator section associated with a heat source, an adiabatic section through which working fluid vapor and, in some designs, working fluid passes and a condenser section in association with a heat sink. In the evaporator section, the working fluid is in a liquid state. Heat absorbed from the heat source causes the working fluid to change from a liquid to a vapor. This vapor passes through the adiabatic region and changes from a vapor to a liquid in the condenser section as heat is given up to the heat sink. The liquid in the condenser is returned to the evaporator by the force of gravity and/or capillary forces through a wick. The return path is either through the adiabatic section or another return passage.

Along these lines, U.S. Pat. No. 5,651,258 to Harris disclose an air conditioning system wherein a coil, in a mode of uncontrolled and continuous operation, is coupled to the liquid line leaving a condenser and disposed in the air leaving an evaporator. The liquid refrigerant is cooled prior to entering the evaporator in which process the cooling capacity of the evaporator is increased and the heat removed from the liquid refrigerant reheats the air leaving the evaporator. In addition the system discloses a coil coupled to the hot gas discharge line of a compressor disposed in the air leaving the subcool coil in a configuration which allows only limited control over the amount of reheat provided by said hot gas reheat coil.

In the types of systems referred to above, the dehumidification capacity of the system is increased and the sensible capacity of the system is decreased. This mode of operation is desirable during times of higher latent load and lower total cooling load, but may not be desirable during times of lower latent load and higher total load. At high loads, the maximum sensible cooling capacity of the system is required to cool the hot air to the desired temperature and less dehumidification (latent) capacity is available to remove moisture from the air. Therefore, it is desirable to control the reheat energy of the system.

One approach to providing fresh air ventilation to a building is illustrated in U.S. Pat. No. 5,179,998 to Des Champs which discloses a system comprised of a cooling coil for cooling and dehumidifying fresh air, a first plate type air-to-air heat exchanger which exchanges heat with the incoming fresh air prior to the cooling coil and exhaust air from a building and second plate type air-to-air heat exchanger which exchange heat with the cool, saturated air leaving the cooling coil and exhaust air from a building. This type of system cools the air prior to entering the cooling coil which reduces the energy required for cooling and reheats the air leaving the cooling coil to reduce the relative humidity of the air prior to entering the building. These types of plate heat exchangers imposes a significant resistance to air flow which must be overcome by the use of a fan motor of greater horsepower in order to achieve the proper airflow. In addition, these types of plate heat exchangers require that the exhaust and fresh air streams be adjacent which can limit the application of this type of system where the air streams are not adjacent.

Therefore, it is an object of this invention to overcome the aforementioned inadequacies of the prior art devices and provide an improvement which is a significant contribution to the advancement of the prior art.

Accordingly, it is an object of this invention to provide an air conditioning system including a controllable subcooling heat exchanger for subcooling liquid refrigerant prior to entering an evaporator while simultaneously reheating the air leaving the evaporator.

It is a further object of this invention to provide an air conditioning system including a hot gas heat exchanger with variable control for reheating air in a post evaporator configuration.

It is a further object of this invention to provide an air conditioning system for providing dehumidified air at the proper temperature for sensible cooling in systems having recirculated high proportions of fresh air or 100% fresh air in the inlet air flow.

It is a further object of this invention to provide an air conditioning system for providing conditioned air which operates with high energy efficiency.

The foregoing has outlined some of the more pertinent objects of the invention. These objects should be construed to be merely illustrative of some of the prominent features and applications of the present invention. It will be apparent to those skilled in art that many other beneficial results can be obtained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings. Many changes and modifications within the scope of the present invention may be made without departing from the spirit thereof, and the invention includes all such modifications.

SUMMARY OF THE INVENTION

For the purposes of summarizing this invention, this invention includes an apparatus which includes a housing having an inlet, an outlet, an evaporator for cooling and dehumidifying air, a blower for inducing air flow through the housing, a subcooling heat exchanger for subcooling liquid refrigerant being delivered to an evaporator from a condenser and for heating air downstream from said evaporator in a controlled manner, a hot gas heat exchanger coupled to the hot gas discharge line of a compressor for further heating air downstream of an evaporator in a controlled manner. The apparatus also preferably comprises an air bypass or face and bypass apparatus for controlling the heating of the subcooling heat exchanger and the hot gas heat exchanger.

In accordance with another aspect of this invention, a control valve, located in the refrigerant liquid line, provides a means of controlling the heating capacity of the subcooling heat exchanger and a valve or a series of valves in the hot gas discharge line of the compressor provides a means of heating capacity to the hot gas heat exchanger.

In accordance with another aspect of this invention, this invention includes an apparatus which includes a housing having an inlet and an outlet, an evaporator or cooling coil for cooling and dehumidifying air, said evaporator comprising the evaporator portion of a refrigeration system, said refrigeration system comprises also of a compressor and condenser, a blower for inducing an air flow through said housing and a blower for inducing air flow across the condenser. A heat pipe heat exchanger comprised of an evaporator section disposed in the leaving air of said condenser and the condenser section of the heat pipe heat exchanger disposed between the evaporator or cooling coil and the outlet of said housing for heating the air. The evaporator section and the condenser section of the heat pipe heat exchanger are interconnected with lines for transporting vaporized working fluid from the evaporator section to the condenser and for returning liquid working fluid form the condenser section to the evaporator section.

In accordance with another aspect of this invention, a first heat exchanger of the air-to-air type is used to cool inlet air to said housing in the cooling mode of operation and heat inlet air in the heating mode of operation by exchanging heat with building exhaust or return and exhaust air mix. A second air-to-air heat exchanger is used to reheat air leaving a cooling coil in the cooling mode of operation and heat air leaving the first heat exchanger in the heating mode of operation. The condenser, in the case of a direct expansion system, is disposed either in the exhaust air upstream of the second heat exchanger to heat the air entering the second heat exchanger and provide a greater capacity for reheating the air leaving the evaporator, or in the exhaust air stream downstream of the first heat exchanger to provide cooler air to the condenser and increase the energy efficiency of the system.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention. Shown in the various figures are eight embodiments of the present air conditioning system.

Figure 1:
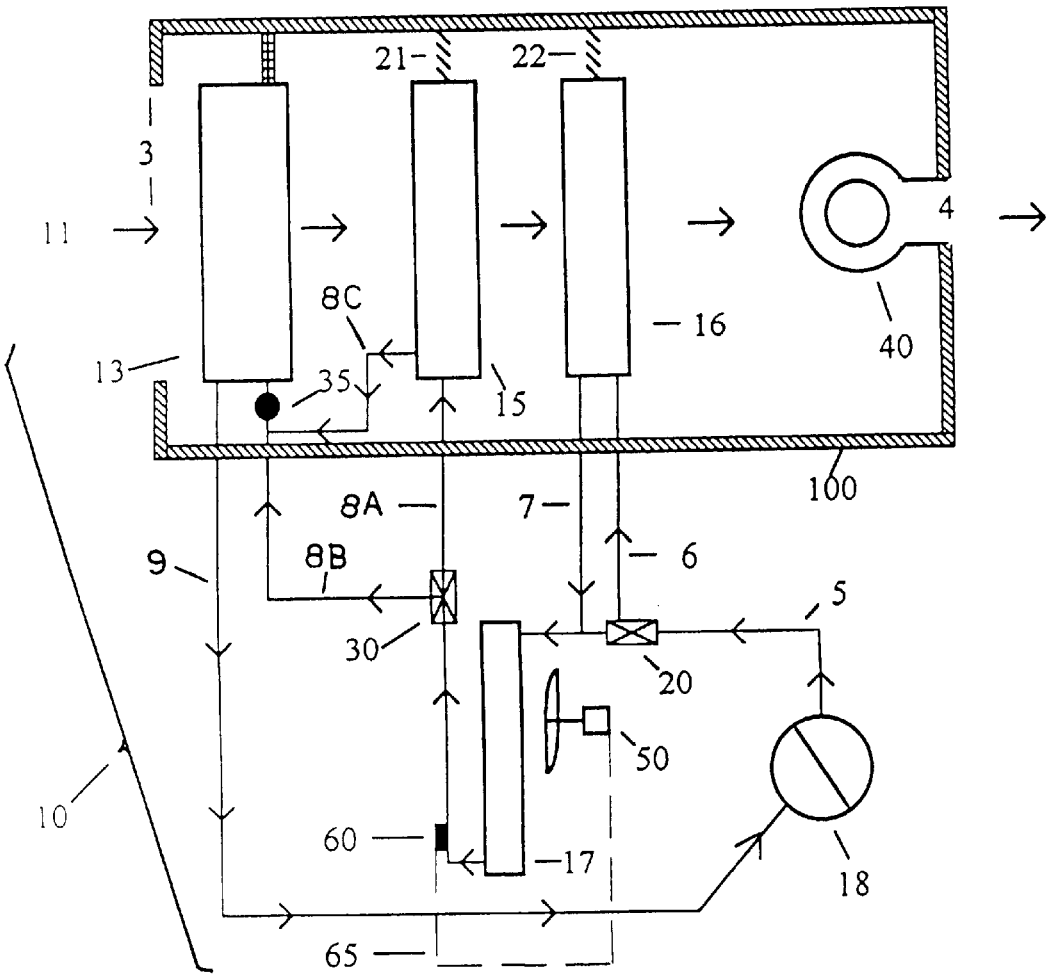
FIG. 1 is a schematic of a first embodiment of the invention.

In the FIG. 1 embodiment there is shown the system 10, which system includes an inlet 3 and an outlet 4. Air is drawn through housing 100 by blower 40 with direction of air flow being indicated by arrows 11. Compressor 18, condenser 17 with associated condenser blower 50 and evaporator 13 circulate refrigerant through said compressor 18, said condenser 17 and said evaporator 13 as should be easily understood by those skilled in the art. A subcooling heat exchanger 15 for subcooling the liquid refrigerant flowing from said condenser 17 to said evaporator 13 through metering device 35 and for reheating the air leaving said evaporator 13 is located downstream of the evaporator 13. Control of said subcooling heat exchanger 15 is provided by either control valve 30 or air bypass device 21. Said control valve 30 interrupts the flow of liquid refrigerant to said subcooling heat exchanger 15 by diverting the liquid refrigerant flow directly to said evaporator 13 through said metering device 35 or said control valve 30 varies the flow of liquid refrigerant proportionally to each of said subcooling heat exchanger 15 and said evaporator 13. When said air bypass device 21 is in the closed position, air leaving said evaporator 13 can pass through said subcooling heat exchanger 15 and the air is reheated. When said air bypass device 21 is in the open position, air leaving said evaporator 13 passes over the top of said subcooling heat exchanger 15 and the air is not reheated. Said air bypass device 21 can also function in a proportional manner allowing some air to pass through said subcooling heat exchanger 15 and some air to bypass said subcooling heat exchanger 15 to proportionally vary the heating capacity of said subcooling heat exchanger 15.

A hot gas heat exchanger 16 for reheating the air in a post evaporator position is disposed downstream of said evaporator 13. Control of the hot gas heat exchanger is provided by either post-compressor control valve 20 (which may be a single valve or a series of valves) or second air bypass device 22. Post-compressor control valve 20 interrupts the flow of liquid refrigerant to said hot gas heat exchanger 16 by diverting the hot gaseous refrigerant flow directly to said condenser 17 or said post-compressor control valve 20 varies the flow of hot gaseous refrigerant proportionally to each of said hot gas heat exchanger 16 and said condenser 17. When said second air bypass device 22 is in the closed position, air leaving said subcooling heat exchanger 15 can pass through said hot gas heat exchanger 16 and the air is reheated. When said second air bypass device 22 is in the open position, air leaving said subcooling heat exchanger 15 passes over the top of said hot gas heat exchanger 16 and the air is not reheated. Said second air bypass device 22 can also function in a proportional manner allowing some air to pass through said hot gas heat exchanger 16 and some air to bypass said hot gas heat exchanger 16 to proportionally vary the heating capacity of said hot gas heat exchanger 16.

In order to control the cooling capacity of said evaporator 13 and maintain an elevated temperature in refrigerant liquid line 8 to maintain the heating capacity of said subcooling heat exchanger 15, the air flow rate across said condenser 17 is controlled by varying the speed of said condenser blower 50 where the temperature of the liquid refrigerant in said refrigerant liquid line 8 is sensed by liquid line sensor 60. Said condenser blower 50 is controllably connected to said liquid line sensor 60 by a blower control line 65. Refrigerant flows from said compressor 18 to said post-compressor control valve 20 through a compressor outlet line 5. Refrigerant flows from said post-compressor control valve 20 to said hot gas heat exchanger 16 through a post-compressor control valve outlet line 6. Refrigerant flows from said hot gas heat exchanger 16 to said condenser 17 through a hot gas heat exchanger outlet line 7. From said condenser 17 refrigerant flows to said control valve 30 and, based upon the status of said control valve 30 either flows into said subcooling heat exchanger 15 through first post-valve line 8A or into said evaporator 13 through second post-valve line 8B or proportionally into each said first post-valve line 8A and said second post-valve line 8B. Any refrigerant directed by said control valve 30 into said subcooling heat exchanger 15 exits therefrom and flows to said metering device 35 through metering device line 8C. Said first post-valve line 8A and said metering device line 8C create a secondary loop for refrigerant associated with said subcooling heat exchanger 15. From said metering device 35 refrigerant flows into said evaporator 13 and returns therefrom to said compressor 18 through compressor inlet line 9.

Figure 2:
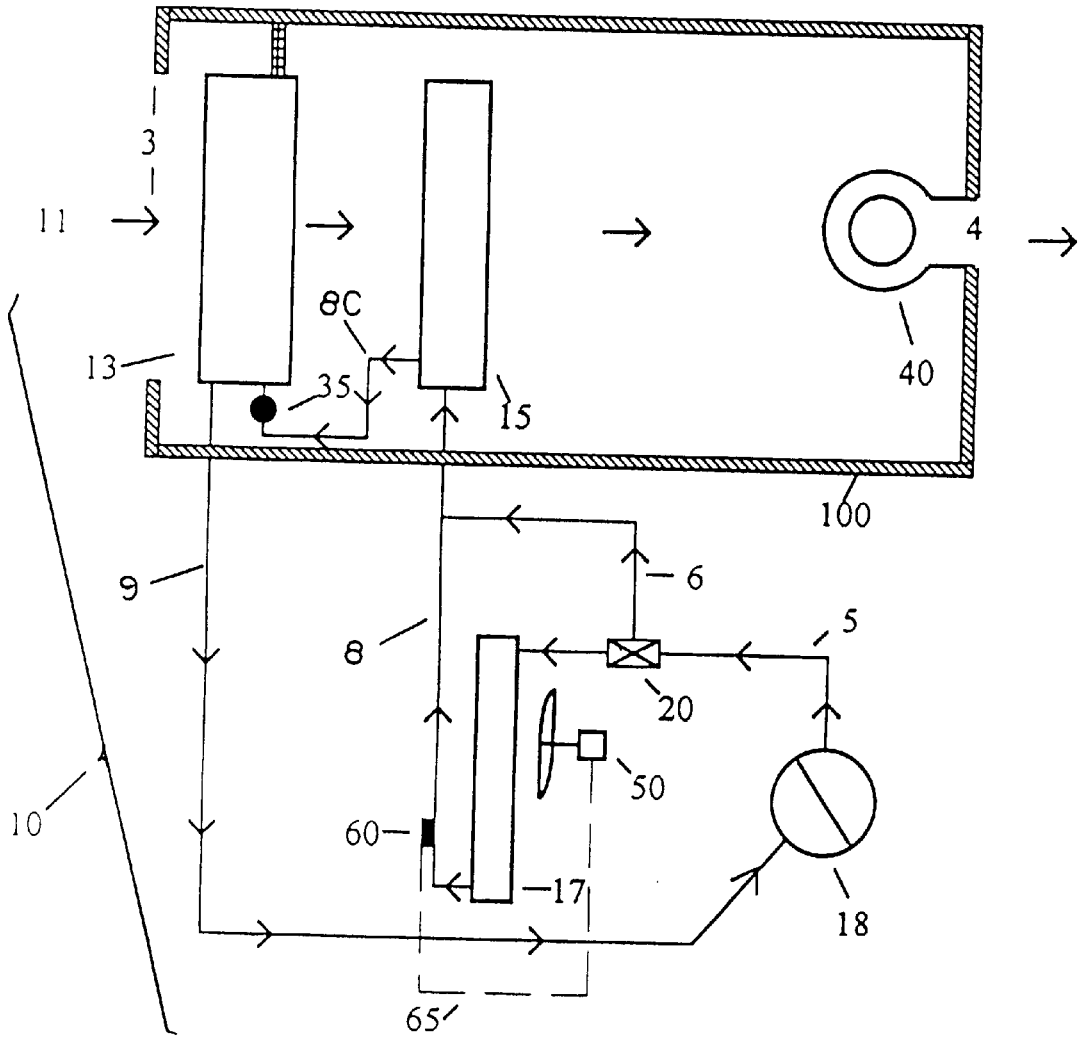
FIG. 2 is a schematic of a second embodiment of the invention.

In the FIG. 2 embodiment is shown said system 10, which system includes said inlet 3 and said outlet 4. Air is drawn through said housing 100 by said blower 40 with the direction of said air flow being indicated by arrows 11. Said compressor 18, said condenser 17 with said condenser blower 50 and said evaporator 13 circulate refrigerant through said compressor 18, said condenser 17 and said evaporator 13 as should be readily understood by those skilled in the art. Said subcooling heat exchanger 15 is disposed in the air leaving evaporator 13 to reheat air flowing therethrough. In the first mode of operation, said post-compressor control valve 20 directs all of the hot gas from said compressor 18 into said condenser 17 and said subcooling heat exchanger 15 subcools the liquid refrigerant flowing from said condenser 17 to said evaporator 13 through said metering device 35 and reheats air leaving said evaporator 13. In order to control the cooling capacity of said evaporator 13 and maintain an elevated temperature in said refrigerant liquid line 8 to maintain the heating capacity of said heat exchanger 15, the air flow rate across said condenser 17 is controlled by varying the speed of said condenser blower 50 where the temperature of the liquid refrigerant in said refrigerant liquid line 8 is sensed by said liquid line sensor 60. Refrigerant flows from said compressor 18 to said post-compressor control valve 20 through said compressor outlet line 5. Refrigerant then flows from said post-compressor control valve 20 to said refrigerant liquid line 8 through said post-compressor control valve outlet line 6. From Said refrigerant liquid line 8 refrigerant flows into said subcooling heat exchanger 15. From there refrigerant flows into said metering device 35 through metering device line 8C. From said metering device 35 refrigerant flows into said evaporator 13 and returns therefrom to said compressor 18 through compressor inlet line 9. Said condenser blower 50 is controllably connected to said liquid line sensor 60 by said blower control line 65.

In another mode of operation, said post-compressor control valve 20 directs some portion of the hot gas to said subcooling heat exchanger 15 through said post-compressor control valve outlet line 6 and some portion of the hot gas to said condenser 17 to further reheat the air leaving said evaporator 13. Said post-compressor control valve 20 can direct all of the hot gas to said subcooling heat exchanger 15 to provide the maximum capacity for reheat.

Figure 3:
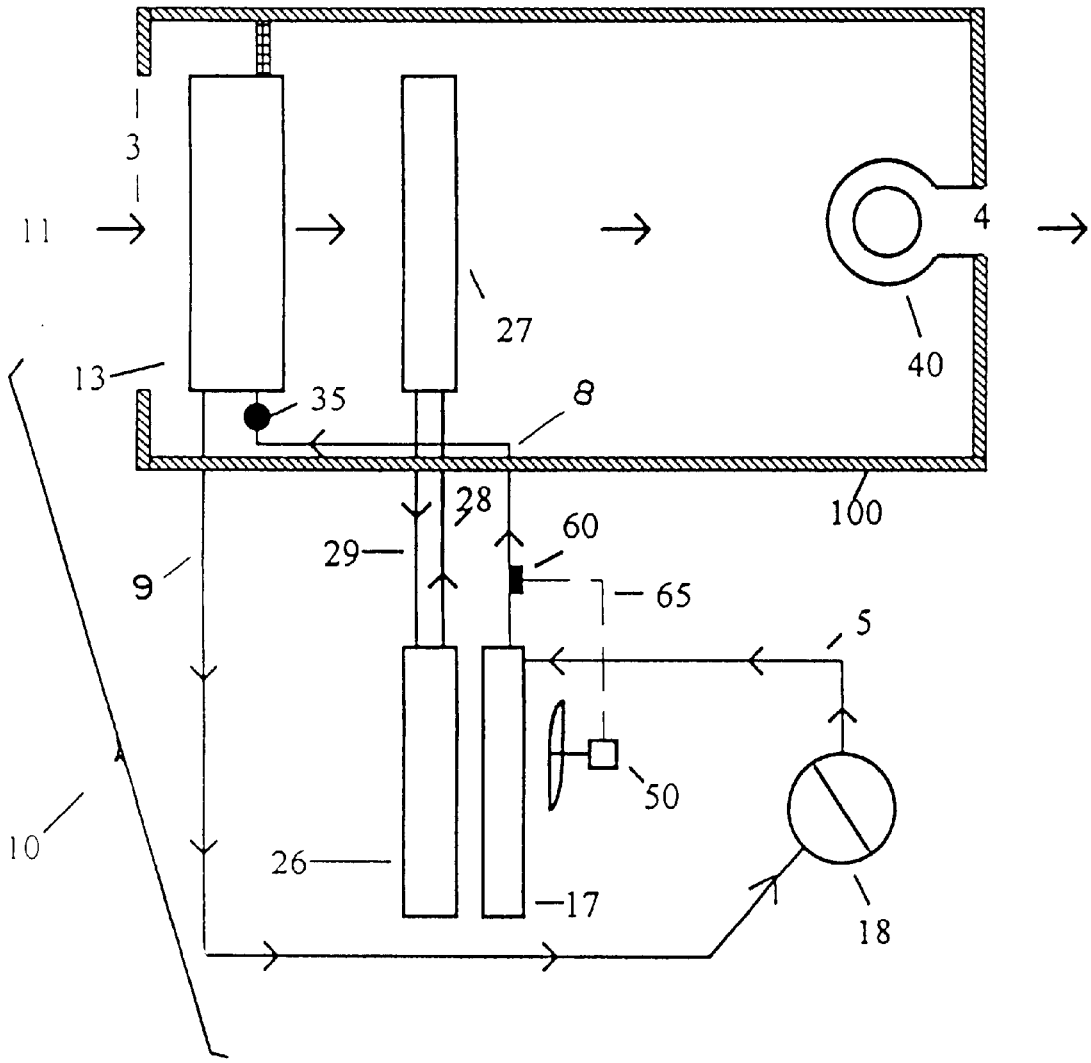
FIG. 3 is a schematic of a third embodiment of the invention.

In the FIG. 3 embodiment there is shown said system 10, which system includes said inlet 3 and said outlet 4. Air is drawn through said housing 100 by said blower 40 with direction of said air flow being indicated by arrows 11. Said compressor 18, said condenser 17 with said condenser blower 50 and said evaporator 13 circulate refrigerant through said compressor 18, said condenser 17 and said evaporator 13 as should be readily understood by those skilled in the art. A heat pipe heat exchanger 26A is disposed in the system to exchange heat between the air leaving said condenser 17 and the air leaving said evaporator 13 to reheat the air leaving said evaporator 13. The first section 26 of said heat pipe heat exchanger 26A is located in the air leaving said condenser 17 and the second section 27 of said heat pipe is located in the air leaving said evaporator 13. The two sections of said heat pipe heat exchanger 26A are interconnected by heat pipe vapor line 28 and heat pipe liquid line 29.

Said heat pipe exchanger 26A operates in the following manner: Warm air leaving said condenser 17 enters said first section 26 where the working fluid in said first section 26 absorbs heat as it changes from a liquid to a vapor and the vapor passes through said heat pipe vapor line 28 and enters said second section 27. Cold air leaving said evaporator 13 passes through said second section 27 and is reheated as the working fluid changes from a vapor to a liquid. Said heat pipe heat exchanger's 26A cycle of operation is completed when the liquid working fluid flows back to said first section 26 by the force of gravity. In order to control the cooling capacity of said evaporator 13 and maintain an elevated temperature in said refrigerant liquid line 8, the air flow rate across said condenser 17 is controlled by varying the speed of said condenser blower 50 where the temperature of the liquid refrigerant in said refrigerant liquid line 8 is sensed by liquid line sensor 60. Refrigerant flows from said compressor 18 to said condenser 17 through said compressor outlet line 5. Refrigerant then flows from said condenser 17 to said evaporator 13 through said refrigerant liquid line 8 and said metering device 35. Said condenser blower 50 is controllably connected to said liquid line sensor 60 by said blower control line 65.

Figure 4:
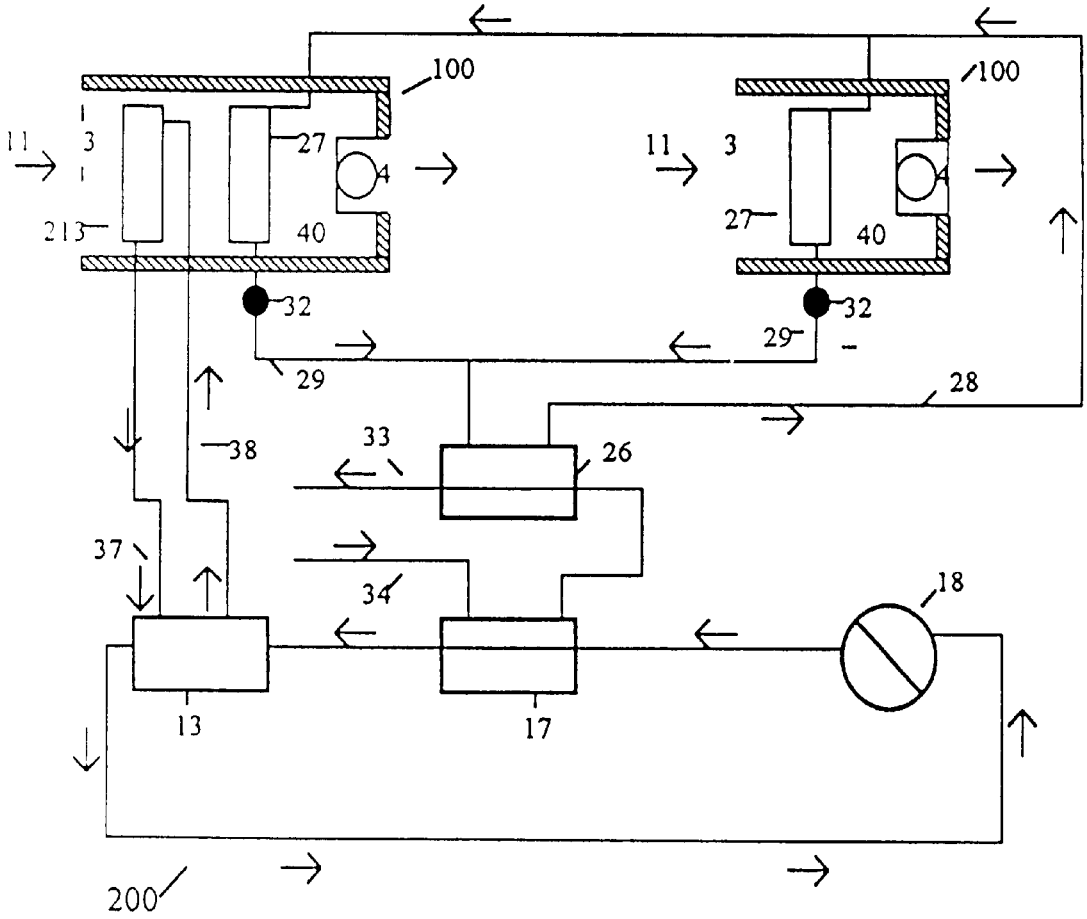
FIG. 4 is a schematic of a first embodiment of the invention.

The FIG. 4 embodiment is comprised of a water cooled chiller system 200; said chiller system 200 being comprised of said compressor 18, said condenser 17 and Said evaporator 13. Cooling water flows from said condenser 17 to a heat sink such as a cooling tower (not shown) through a cooling line 33 and returns from a cooling tower or other heat sink through return line 34. Chilled water flows from said vaporator 13 to one or more chilled water coils 213 through chilled water line 38 and returns from said chilled water coils 213 through return water line 37. The system is further comprised of one or more of said housings 100, here shown two in number, each having said inlet 3 and said outlet 4. Air is drawn through each said housing 100 by said blowers 40 with direction of said air flow being indicated by arrows 11. Said heat pipe heat exchanger 26A is disposed in this embodiment to exchange heat between said condenser 17 and the air leaving said chilled water coils 213 to reheat the air leaving said chilled water coils 213. Said first section 26 of said heat pipe heat exchanger 26A being a liquid heat exchanger located on said cooling line 33 and said second section 27 of said heat pipe heat exchanger 26A is located in the air leaving said chilled water coils 213. The two sections of said heat pipe heat exchanger are interconnected through said heat pipe vapor line 28 and said heat pipe liquid line 29. A heat transfer control valve is placed along said heat pipe liquid line 29 in between said housing 100 and said first section 26.

In order to provide reheat, said heat pipe heat exchanger operates in the following manner: Warm water leaving said condenser 17 through said chilled water line 33 enters said first section 26 of said heat pipe heat exchanger 26A where the working fluid absorbs heat as it changes from a liquid to a vapor and this vapor passes through said heat pipe vapor line 28 and enters said second section 27 of said heat pipe heat exchanger 26A. Cold air leaving chilled water coils 213 passes through said second section 27 and is reheated as the working fluid changes from a vapor to a liquid. Said heat pipe heat exchanger's 26A cycle of operation is completed when the working fluid returns to said first section 26 by the force of gravity through said heat pipe liquid line 29.

In another mode of operation, said heat pipe heat exchanger 26A can provide economical cooling to a conditioned space by transferring heat from said second section 27 which now functions as evaporator section and said first section 26 which now functions as the condenser section of said heat pipe heat exchanger 26A. In this mode, said heat pipe heat exchanger 26A functions in the following manner: Warm air flowing through said housing 100 passes through said second section 27 where the working fluid absorbs heat as it changes from a liquid to a vapor and the vapor passes through said heat pipe vapor line 28 and enters said first section 26. Cold water passes through said first section 26 and absorbs heat from the working fluid in said heat pipe heat exchanger as the working fluid changes from a vapor to a liquid. Said heat pipe heat exchanger's cycle of operation is completed when the liquid working fluid flows back to said second section 27 by the force of gravity through said heat pipe liquid line 29.

Figure 5:
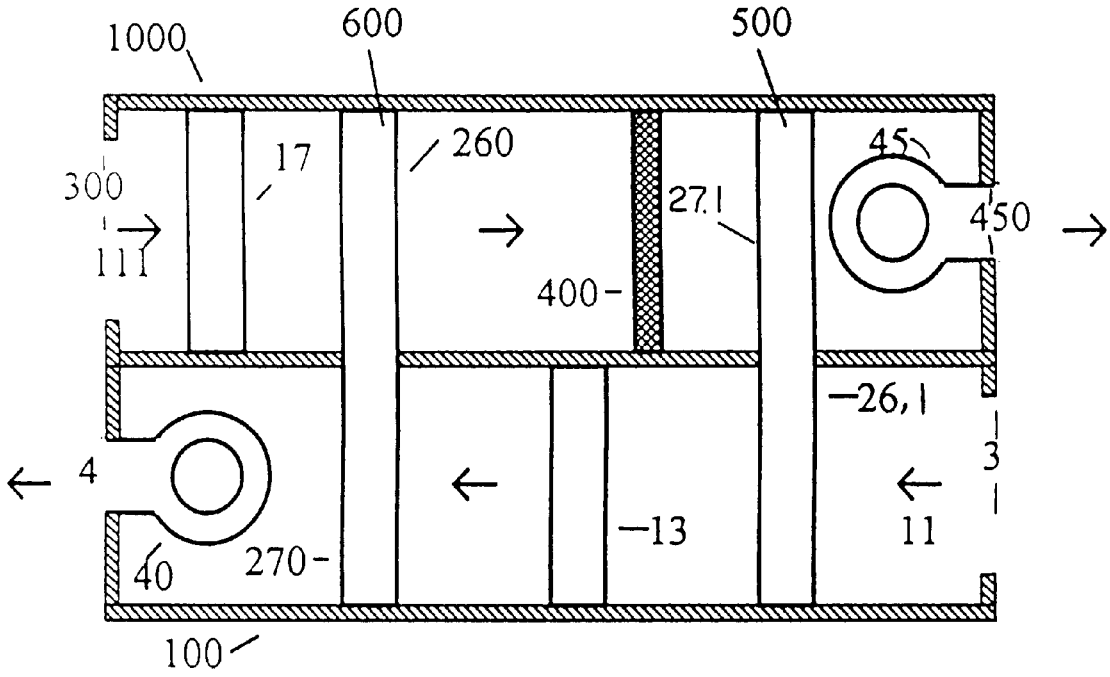
FIG. 5 is a schematic of a second embodiment of the invention.

The FIG. 5 embodiment is comprised of said housing 100 with said inlet 3 and said outlet 4. Air is drawn through said housing 100 by said blower 40 with direction of said air flow being indicated by arrows 11. Said housing 100 contains a first exchanger 26.1 of a first air-to-air heat exchanger 500, said evaporator 13 and an forth exchanger 270 of a second air-to-air heat exchanger 600. The embodiment is further comprised of second housing 1000 with second inlet 300 and second outlet 450. Air is drawn through said second housing 1000 by second blower 45 with direction of second air flow being indicated by arrows 111. Said second housing 1000 contains said condenser 17, a third exchanger 260 of said second air-to-air hear exchanger 600 an evaporative cooling device 400 and a second exchanger section 27.1 of said air-to-air heat exchanger 500. Air entering inlet 3 passes over said first air-to-air heat exchanger 500 and is cooled when heat is exchanged with the cooler air flowing through said second housing 1000. Next the air passes through said evaporator 13 and is cooled further and dehumidified. The air then flows over said forth exchanger section 270 of said second air-to-air heat exchanger 600 and the air is reheated when heat is exchanged with the air flowing through said second housing 1000. The air flowing through said second housing 1000 enters through said second inlet 300 and passes through said condenser 17 where it is heated to provide the energy for heat exchange as the air passes through said second air-to-air heat exchanger 600. The air then flows through evaporative cooling device 400 where it is cooled following the well known principles of evaporator cooling of air. The cool air then flows through said first air-to-air heat exchanger 500 where heat is exchanged with the air flowing through said housing 100. In a heating mode of operation, said first air-to-air heat exchanger 500 and said second air-to-air heat exchanger 600 will conserve heating energy by transferring heat from the air flowing through said second housing 1000 into the air flowing through housing 100.

Figure 6:
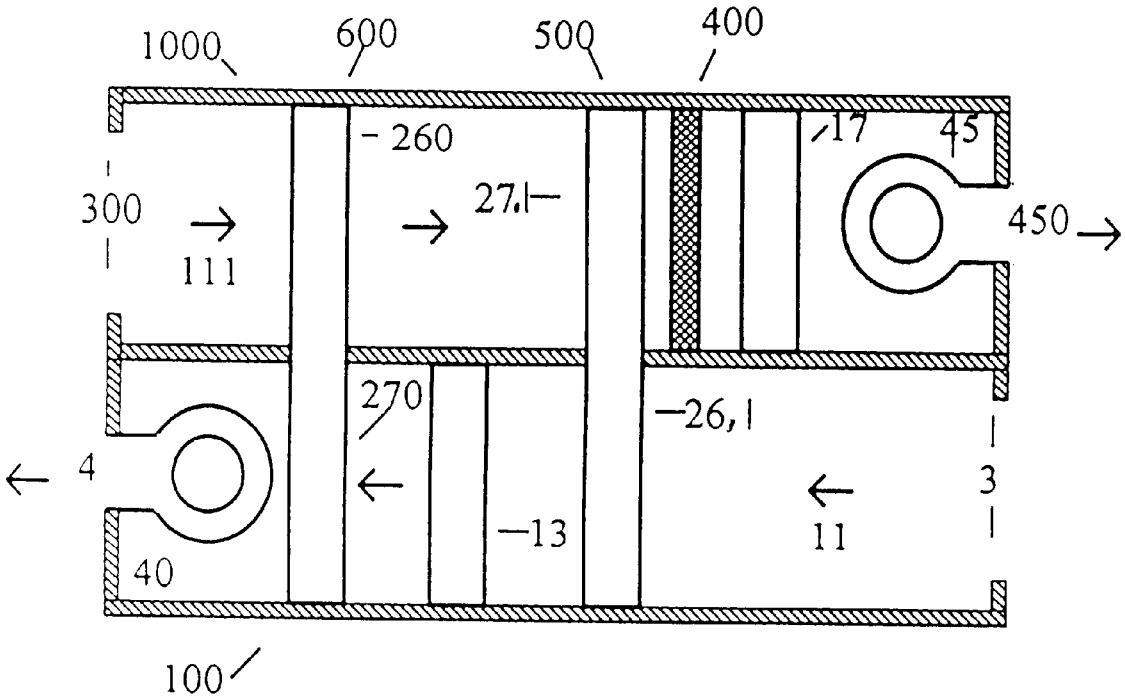
FIG. 6 is a schematic of a third embodiment of the invention.

The FIG. 6 embodiment is comprised of said housing 100 with said inlet 3 and said outlet 4. Air is drawn through said housing 100 by said blower 40 with direction of said air flow being indicated by arrows 11. Said housing 100 contains the first exchanger section 26.1 of said air-to-air heat exchanger 500, said evaporator 13 and said fourth exchanger section 270 of said second air-to-air heat exchanger 600. The embodiment is further comprised of said second housing 1000 with said second inlet 300 and said second outlet 450. Air is drawn through said second housing 1000 by said second blower 45 with direction of said second air flow being indicated by arrows 111. Said second housing 1000 contains said third exchanger section 260 of said second air-to-air heat exchanger 600, said second exchanger section 27.1 of said first air-to-air heat exchanger 500, said evaporative cooling device 400 and said condenser 17. Air entering said inlet 3 passes over said first air-to-air heat exchanger 500 and is cooled when heat is exchanged with the cooler air flowing through said second housing 1000. Next the air passes through said evaporator 13 and is cooled further and dehumidified. The air then flows over said fourth exchanger 270 of said second air-to-air heat exchanger 600 and the air is reheated when heat is exchanged with the air flowing through said second housing 1000. The air flowing through said second housing 1000 enters through said second inlet 300 and is cooled as the air passes through said second heat exchanger 600 and heat is exchanged with the air passing through said housing 100. Next the air is heated when it passes through said second exchanger 27.1 of said first air-to-air heat exchanger 500 and heat is exchanged with air passing through said housing 100. The air then flows through said evaporative cooling device 400 where it is cooled following the well known principles of evaporator cooling of air. The cool air then flows through said condenser 17.

In the heating mode of operation, said first air-to-air heat The cool air then flows exchanger 500 and said second air-to-air heat exchanger 600 will conserve heating energy by transferring heat from the air flowing through said second housing 1000 into the air flowing through said housing 100.

Figure 7:
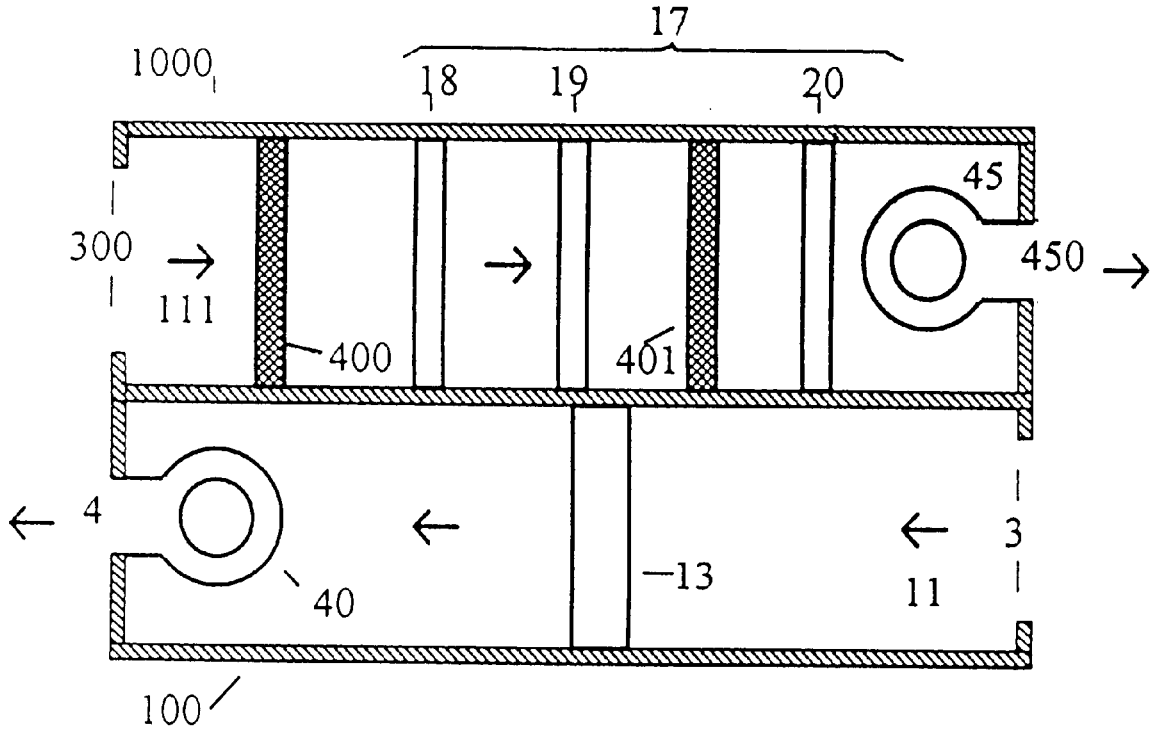
FIG. 7 is a schematic of a second embodiment of the invention.

The FIG. 7 embodiment is comprised of said housing 100 with said inlet 3 and said outlet 4. Air is drawn through said housing 100 by said blower 40 with direction of said air flow being indicated by arrows 11. Said housing 100 contains said evaporator 13. The embodiment is further comprised of said second housing 1000 with said second inlet 300 and said second outlet 450. Air is drawn through said second housing 1000 by said second blower 45 with direction of said second air flow being indicated by arrows 111. Said second housing 1000 contains said evaporative cooling device 400 and said condenser 17 with said condenser 17 being comprised of first heat exchanger 18, second heat exchanger 19, a second evaporative cooling device 401 and third heat exchanger 20. Air entering said inlet 3 passes through said evaporator 13 and is cooled and dehumidified. The air flowing through said second housing 1000 enters through said second inlet 300 and is cooled as the air passes through said evaporative cooling device 400 where it is cooled following the well known principles of evaporator cooling of air. The cool air then flows through said condenser 17 where it first flows through said first heat exchanger 18 performing the function of subcooling the liquid refrigerant in said condenser 17, a process well known to those schooled in the art. Next the air flows through said second heat exchanger 19 where the condensing process takes place and then through said second evaporative cooling device 401 where the air is cooled. Finally, the air flows through said third heat exchanger 20 where the desuperheating process takes place. This decoupling of the three processes of a condenser results in a more energy efficient system.

Figure 8:
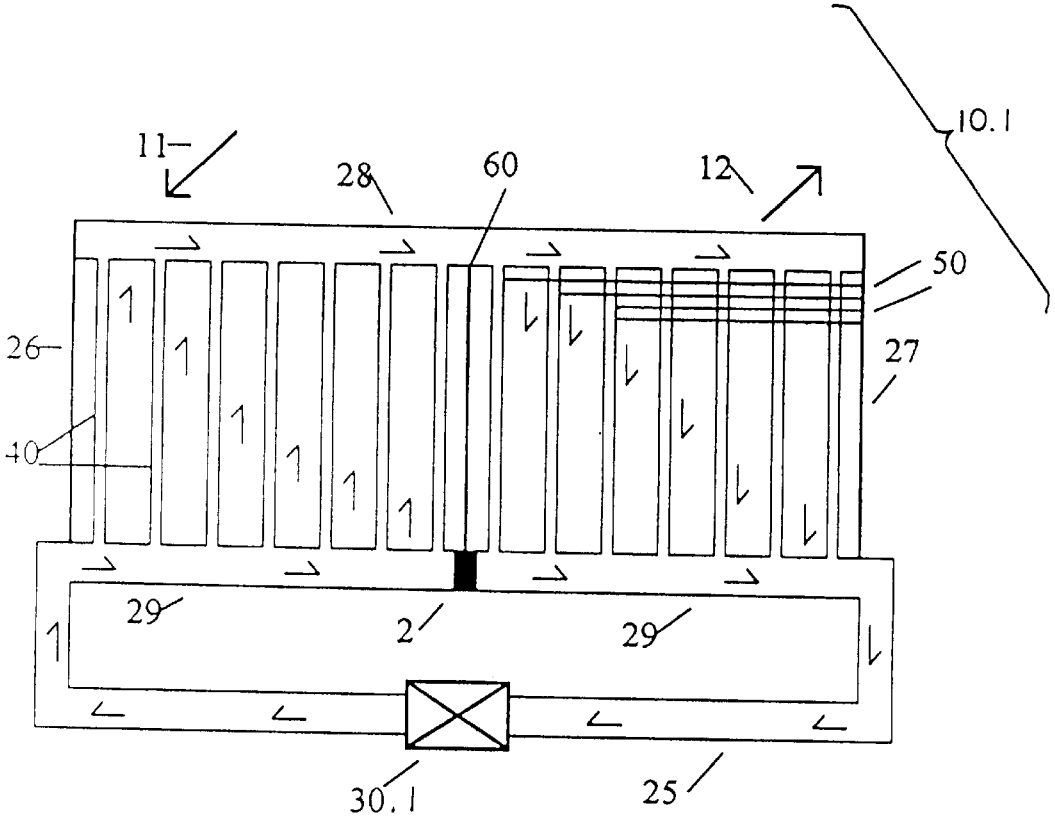
FIG. 8 is a schematic of an advanced heat pipe heat exchanger.

FIG. 8 illustrates an improved air-to-air, controllable heat pipe heat exchanger 10.1 and is comprised of an upper header 28A and a lower header 29A interconnected by a plurality of pipes 40. Each of said pipes 40 is provided with spaced fins 50 along its entire length to enhance the transfer of heat between the working fluid and air. Said first section 26 and said second section 27 are divided by divider 60 to accommodate the passage of two airstreams of different temperatures with direction of air flow of a warmer air stream being shown by arrow 11 and the direction of a cooler air stream being shown by arrow 12. In FIG. 8, said first section 26 functions as the evaporator section of said heat pipe heat exchanger 10.1 and said second section 27 functions as the condenser section of said heat pipe heat exchanger 10.1. Header 29A is provided with an insert 2 to prevent the passage of working fluid from one side of said insert 2 to the other.

The two ends of said header 29A opposite said insert 2 are connected by header pipe 25 in which is disposed header control valve 30.1. Said heat pipe heat exchanger 10.1 operates in the following manner: With said header control valve 30.1 in the open position, the working fluid in said first section 26 absorbs heat from the warm air flowing through said first section 26 as the working fluid changes from a liquid to a vapor and the vapor flows through header 28A and enters said second section 27. Heat is released to the cool air flowing through said second section 27 as the working fluid changes from a vapor to a liquid. Said heat pipe heat exchanger's 10.1 cycle of operation is completed when the liquid working fluid returns to said first section 26 through said header pipe 25 by the force of gravity. When said header control valve 30.1 is closed, the liquid working fluid is prevented from returning to said first section 26 and the heat transfer process is interrupted.

Figure 9:
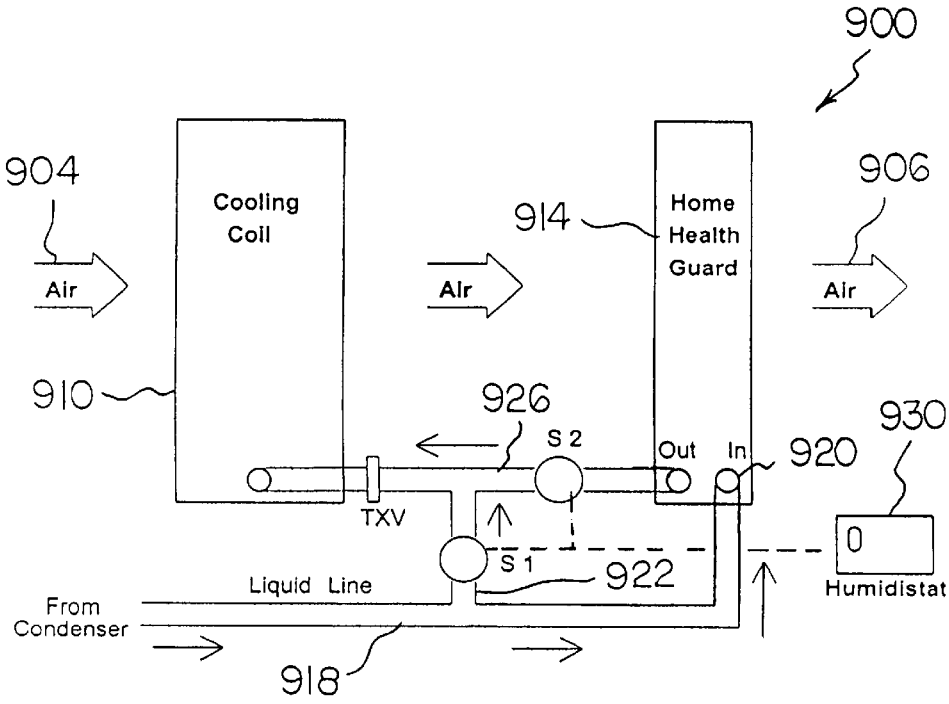
FIG. 9 is a schematic illustration of a health guard system application to the FIG. 1 embodiment or to any of the other prior embodiments.
Figure 10A:
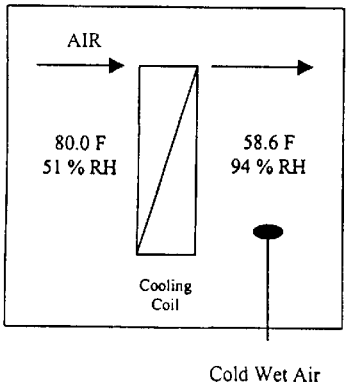
FIGS. 10A and 10B are schematic showings of typical performances with and without the health guard system of FIG. 9.
Figure 10B:
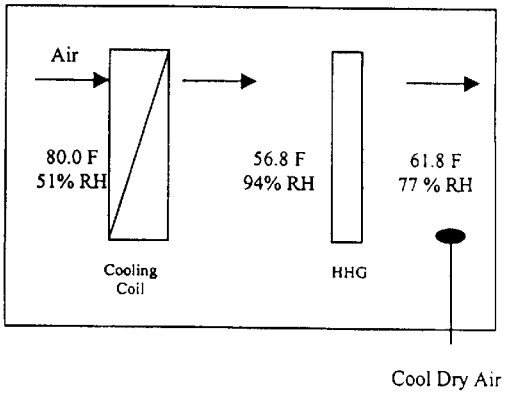
Figure 11:
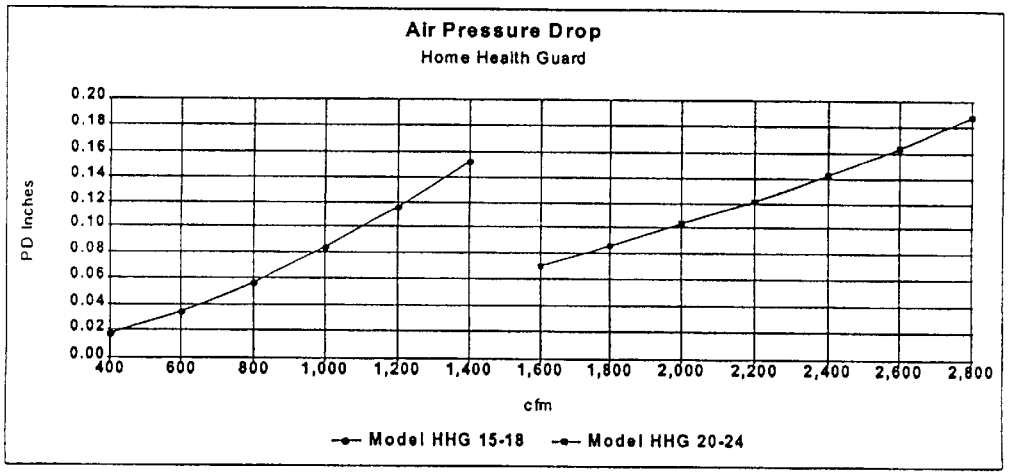
FIG. 11 is a chart of air pressure drops per cubic feet of flow for typical small and large installations of the health guard system of FIG. 9.

Lastly, an additional feature of the invention, a home health guard air conditioning system 900, adapted to passively dehumidify an entire building, is shown in FIG. 9. This feature is readily adapted for any of the prior embodiments of FIGS. 1 through 8. First provided are a supply air duct with an air inlet 904 and an air outlet 906. A blower is provided for the flow of air to be conditioned as it is moved from the inlet to the outlet.

Next provided in this embodiment is an evaporator 910 within the duct adjacent to the inlet. The evaporator has cooling coils to cool the air passing there through. The evaporator is adapted to receive coolant from the condenser and feed the coolant to a compressor.

A subcooling heat exchanger 914 is provided within the duct between the evaporator and the outlet to receive air after passing through the evaporator and prior to the passage of the air through the air outlet into a chamber to be conditioned.

Next, a liquid line 918 is provided for the feeding of coolant from the condenser. The liquid line has a primary outlet 920 and a secondary outlet 922. The primary outlet is coupled to the subcooling heat exchanger. A 24 volt normally open solenoid valve S1 is provided. The secondary outlet is coupled to the solenoid valve S1 to control the rate of coolant fed therethrough.

Next provided is a coupling line 926 for the feeding of coolant from the subcooling heat exchanger to the evaporator. A 24 volt normally closed solenoid valve S2 is provided in the coupling line adjacent to the subcooling heat exchanger to control the rate of coolant fed therethrough. An intermediate line is coupled between the coupling line and the normally open solenoid valve. A metering device TXV is provided adjacent to the evaporator.

Finally, a humidistat 930 is provided remote from the first and second valves. The humidistat is under the control of an operator for varying the operating parameters of the normally open solenoid valve and normally closed solenoid valve to thereby passively dehumidify to an extent as determined by an operator controlling the air passing through the supply air duct.

The home health guard (HHG) is adapted to be installed in the supply air duct of an air conditioning system to passively dehumidify an entire home and building. The HHG is applicable to straight cool and heat pumps in retrofit, renovation and new installations. The HHG is controlled by a humidistat for true humidity control. The system includes a duct mounted, specially designed subcooling/reheating coil, two-24 volt solenoid valves and a room humidistat.

The home health guard uses the cold supply air to cool the liquid refrigerant before it enters your cooling coil. This process is call "subcooling" and is a common practice in the air conditioning industry. This process increases the moisture removal capability of the air conditioning system and passively reheats the supply air to introduce cool dry air into a building. A humidistat mounted next to the thermostat (or in the return air duct) controls the operation of the home health guard system.

Economy may be demonstrated by comparing the home health guard to a room dehumidifier. Proper dehumidification of your environment would require three room dehumidifiers each removing 45 pints of moisture per day. These would cost about $600.00 to purchase and about $850.00 per year to operate. To dehumidify your entire environment, you would to move the dehumidifiers from room to room and constantly empty the buckets of water from the unit.

A better solution is the home health guard that does the same job as three room dehumidifiers without the operation cost or extra work. HHG costs much less than the three room dehumidifiers and their first year's operating costs. HHG dehumidifies the entire area served by your central air conditioning system. The moisture removed automatically goes outside through the air conditioner's drain line. There are no buckets to empty.

Your air conditioning system must be big enough to cool your home or office at the hottest time of the year. The rest of the time, your system is bigger than it needs to be and it can cool your environment so quickly that the system does no run long enough to remove the proper amount of moisture. This results in high humidity and the growth of mold. Your home health guard solves this common problem by increasing the amount of moisture that your system removes by about 56%. With HHG you will have a cool, dry, comfortable and health environment.

In order to furnish, install, test and place the HHG into service, a home health guard subcool/reheat system is provided as illustrated herein in each of the specified units. The HHG is to be mounted in the supply air duct and will subcool the liquid refrigerant in the liquid line before the refrigerant enters the evaporator through the thermostatic expansion valve.

The duct mounted subcool/reheat heat exchanger is preferably constructed of seamless copper tubing permanently expanded into aluminum fins to form a firm, ridged and complete metal to metal pressure contact between the tube and fin collar at all operating conditions.

A room mounted or duct mounted humidistat in an on/off fashion controls HHG. In addition, the signal from the humidistat is to be deactivated for heat pumps operating in the heating mode.

What is claimed as being new and desired to be protected by Letters Patent of the United States is as follows:

1. A home health guard air conditioning system adapted to passively dehumidify an entire building comprising, in combination:

a supply air duct with an air inlet and an air outlet and at least one air bypass channel to bypass with a blower for the flow of air to be conditioned as it is moved from the inlet to the outlet;

an evaporator within the duct adjacent to the inlet, the evaporator having cooling coils to cool the air passing there through, the evaporator adapted to receive coolant from the condenser and feed the coolant to a compressor;

a subcooling heat exchanger within the duct between the evaporator and the outlet to receive air after passing through the evaporator and prior to the passage of the air through the air outlet into a chamber to be conditioned;

a liquid line for the feeding of coolant from the condenser, the liquid line having a primary outlet and a secondary outlet, the primary outlet being coupled to the subcooling heat exchanger, the secondary outlet being coupled to a 24 volt normally open solenoid valve to control the rate of coolant fed therethrough; a coupling line for the feeding of coolant from the subcooling heat exchanger to the evaporator, the coupling line having a 24 volt normally closed solenoid valve adjacent to the subcooling heat exchanger to control the rate of coolant fed there through and a metering device adjacent to the evaporator and, in addition, an intermediate line coupled to the normally open solenoid valve;

a humidistat remote from, but operatively coupled to, the first and second valves under the control of an operator for varying the operating parameters of the normally open solenoid valve and normally closed solenoid valve to thereby passively dehumidify to an extent as determined by an operator controlling the air passing through the supply air duct.

2. An air conditioner controller comprising:

a supply air duct with an air inlet and an air outlet and with a blower;

an evaporator within the duct adjacent to the inlet;

a subcooling heat exchanger within the duct having an associated air by-pass between the evaporator and the outlet to allow air to bypass the subcooling heat exchanger;

a liquid line for the feeding of coolant from a condenser, the liquid line having a primary outlet and a secondary outlet, the primary outlet being coupled to the subcooling heat exchanger, the secondary outlet being coupled to a first valve;

a coupling line for the feeding of coolant from the subcooling heat exchanger to an evaporator, the coupling line having a second valve adjacent to the subcooling heat exchanger and, in addition, an intermediate line; and a humidistat operatively coupled to the first and second valves under the control of an operator for controlling the first and second valves to thereby vary the operating parameters.

3. The controller as set forth in claim 2 and further including a metering device adjacent to the evaporator in the coupling line.

4. The controller as set forth in claim 2 wherein the controller is remote from the first and second valves.

* * * * *